US005899259A

United States Patent [19]

Rode et al.

[11] Patent Number: 5,899,259

[45] Date of Patent: May 4, 1999

[54] MOLDS FOR A CONTINUOUS CASTING SYSTEM

[75] Inventors: Dirk Rode; Hector Villanueva, both of Osnabrück, Germany

[73] Assignee: KM Europa Metal Aktiengesellschaft, Osnabruck, Germany

[21] Appl. No.: 09/176,743

[22] Filed: Oct. 21, 1998

[30] Foreign Application Priority Data

Oct. 25, 1997 [DE] Germany ..... 197 47 305

[51] Int. Cl.[6] ..... B22D 11/04

[52] U.S. Cl. ..... 164/418

[58] Field of Search ..... 164/418, 91, 459, 164/138; 205/210

[56] References Cited

U.S. PATENT DOCUMENTS 4,538,667 9/1985 Hara et al. ..... 164/418

4,589,468 5/1986 Misera et al. ..... 164/418

5,407,499 4/1995 Gravemann et al. ..... 148/685

5,778,824 8/1998 Cattonne et al. ..... 205/210

*Primary Examiner*—Patrick Ryan

*Assistant Examiner*—Anjan Dey

*Attorney, Agent, or Firm*—Kenyon & Kenyon

[57] ABSTRACT

The invention concerns a mold for a continuous casting system with a shaping mold tube made of a material with high thermal conductivity. To reduce the rate of heat removal at the height of the meniscus that forms within the mold cavity, the exterior of the mold tube is provided with a plating of a material of lower thermal conductivity than that of the mold tube. This results in reduced heat flow with higher temperatures in the meniscus area and in improvement in the surface quality of the cast billet.

18 Claims, 1 Drawing Sheet

MOLDS FOR A CONTINUOUS CASTING SYSTEM

BACKGROUND OF THE INVENTION

This invention concerns a mold for a continuous casting system having a shaping mold body made of a material that has a high level of thermal conductivity, such as copper or a copper alloy.

Molds are used for establishing the profiles of solids that are manufactured in a continuous casting process. The mold is one of the most important components of a continuous casting system, as the melt begins solidifying while within it.

The mold design, in general, includes an outer steel construction. The actual shaping component of the mold is the mold body. Mold bodies are today made almost exclusively of copper or a copper alloy. The function of the steel jacket is to position the mold body and to provide the water circulation required for cooling.

In order to protect it against wear, the mold body is typically provided with an internal plating made of a wear-resistant material such as nickel or chromium. An example of such a continuous casting mold with wear-resistant coating is described in German Patent No. 31 42 196 C2. The friction characteristics and therefore the service life of the mold body can be improved in this manner.

As liquid steel cools while flowing through the mold body, it solidifies in the outer areas, forming a billet layer with a continuously growing thickness. The cross-sectional geometry of the billet changes by shrinking.

Thus, in addition to shaping the billet, the mold body also has the important function of ensuring the formation of a sufficiently thick, high-strength and defect-free billet layer through the continuous removal of heat.

Excessive heat removal and cooling of the steel melt at the beginning of the solidification process, particularly in the meniscus area, negatively affects the billet surface quality. It may result in microcracks in the surface and microstructure defects. These are formed mainly near the edges of the mold body. Furthermore, there is a danger of the billet becoming seized in the tapering mold body.

In order to reduce heat removal in the meniscus area, the method of electromagnetically agitating the melt in the mold body is known. This method is, however, relatively expensive. Furthermore, attempts have been made to reduce heat removal using vertical slots in the internal wall of the mold body or inserts made of refractory material.

Tests with thicker internal wear-protection platings have also been conducted. Due to the difference in heat elongation coefficients of the mold body (mainly copper) and the wear-resistant plating (mainly nickel), considerable stresses appear in the wear-resistant plating. Adherence is negatively affected and cracks may form.

There remains a need to provide a mold body where heat removal, particularly in the meniscus area, is reduced and better billet quality is achieved.

SUMMARY OF THE INVENTION

The present invention addresses this need by providing a mold for a continuous casting system, in which the mold body is made of a material having a high level of thermal conductivity, and is plated along its outer surface with a coating of a material that has a lower level of thermal conductivity than the material of the mold body. A central concern of the present invention is the reduction of the rate of heat removal from the mold body by using an outer plating. Since the coating or plating is made of a material having a low degree of heat conductivity compared with the mold body material, there results a reduced level of heat flow in the meniscus area, which is the process engineering objective addressed by this invention. The resulting higher temperatures have a positive effect on the billet surface quality and microstructure quality.

The mold bodies used with this invention can essentially be single-piece or multi-piece molds, e.g., a plate mold.

Even when it is possible to fully plate the mold body externally, plating is advantageously applied only at the height area of the meniscus. This allows selective reduction of heat removal in the meniscus area, so that the strength of the billet shell is not exceeded.

The thickness and length of the outer plating is adjusted to the casting and plant parameters in each case.

According to one variant of the invention, plating is only applied along a portion of the mold body perimeter. This measure is particularly recommended in the case of non-symmetrical mold bodies. For example, in the case of adjustable molds, it can be advantageous to only provide the longitudinal plates with an outer plating.

Disproportionate shrinking of the billet in certain areas, (e.g., in the corner areas) can be avoided through selective plating. This ensures that heat transfer is approximately uniform over the entire perimeter of the billet, so that a uniformly growing billet shell thickness is achieved over the entire cross-section of the billet.

High-quality and cost-effective plating can be applied electrically. The plating can also be applied by thermal spraying a thermal spray layer.

The plating used may be made of nickel or a nickel alloy. Nickel materials have been successfully used as internal wear-protection platings. Therefore users also often have the resources to nickel plate mold bodies.

Nickel has a heat conductivity that is more than four times lower than that of copper. Accordingly, effective reduction of heat removal and thus increase in temperature in the meniscus area is achieved by nickel plating on the outside.

Nickel can be applied either via electroplating or as a metallic spray coating. It is within the scope of the invention to plate the outer surface of the mold body either fully or only locally in the meniscus area.

According to one embodiment of the invention, the plating has a constant thickness in the direction of casting. The transitions in the plating edge areas are continuous, thus avoiding local concentrations of stresses.

According to another embodiment of the invention, the shrinkage characteristics of the material to be cast can be selectively taken into account by using a plating, in which the thickness diminishes in the direction of casting. In this case, heat removal increases in the direction of casting. In this manner, the amount of cooling available for solidification in the mold can be effectively optimized with regard to the shrinkage characteristics of the billet.

The thickness of the external plating may diminish linearly or stepwise.

Since copper and copper alloys, used as mold body materials, have relatively low wear-resistance, it may prove convenient, depending on the application, to provide the mold body with an internal plating in the known manner. Internal platings made of nickel, chromium, or chrome-plated nickel have been successfully used as internal platings.

BRIEF DESCRIPTION OF THE DRAWINGS

The invention will be described in detail below with reference to the embodiments illustrated in the drawings.

DETAILED DESCRIPTION

Figure 1:
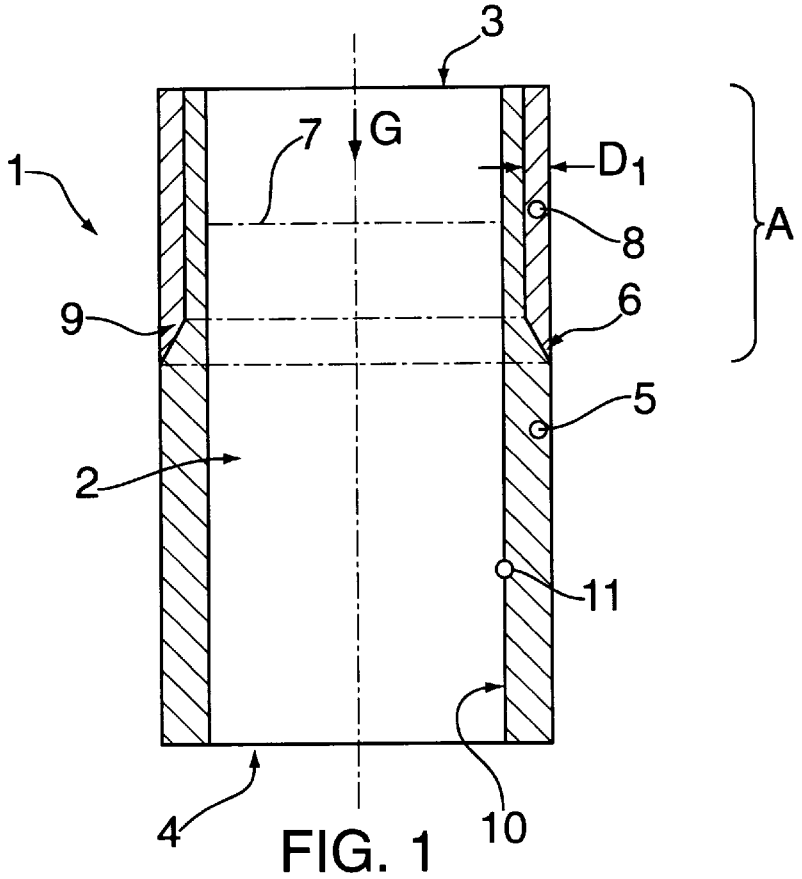
FIGS. 1 through 3 each provide a vertical cross-sectional view of an embodiment of a mold body in the shape of a mold tube constructed according to the principles of the invention.

FIG. 1 shows a mold tube 1 for the continuous casting of steel. Mold tube 1 has a mold cavity 2, whose cross-section is larger at the front, pour-in end 3 than at the rear, billet removal end 4.

Base body 5 of mold tube 1 is made of a copper alloy, preferably a copper/chromium zirconium-based alloy (CuCrZr). On its exterior surface 6, the mold tube 1 has a plating 8 on a part A at the height of the meniscus 7. The plating 8 is made of a material that has a lower heat conductivity compared to the material of the mold tube 1 or base body 5. Nickel is particularly well-suited as the material for the external plating 8. Nickel can be applied either as electroplating or as a thermal spray layer.

Plating 8 reduces the heat flow and therefore heat removal from mold tube 1 at the height of the meniscus 7. This results in higher wall temperatures in the initial phase of billet shell formation and in improved steel billet surface quality. In particular, microcracks near the edges of mold tube 1 can thus be prevented.

As can be seen in FIG. 1, plating 8 has an approximately constant thickness $D_1$ in the direction of casting G. In the transition area 9, the thickness of plating 8 diminishes continuously toward the outer surface 6.

Along the interior surface 10, the mold tube 1 is provided with a wear-protection plating 11 of chromium, which is approximately 80 $\mu$m thick.

Figure 2:
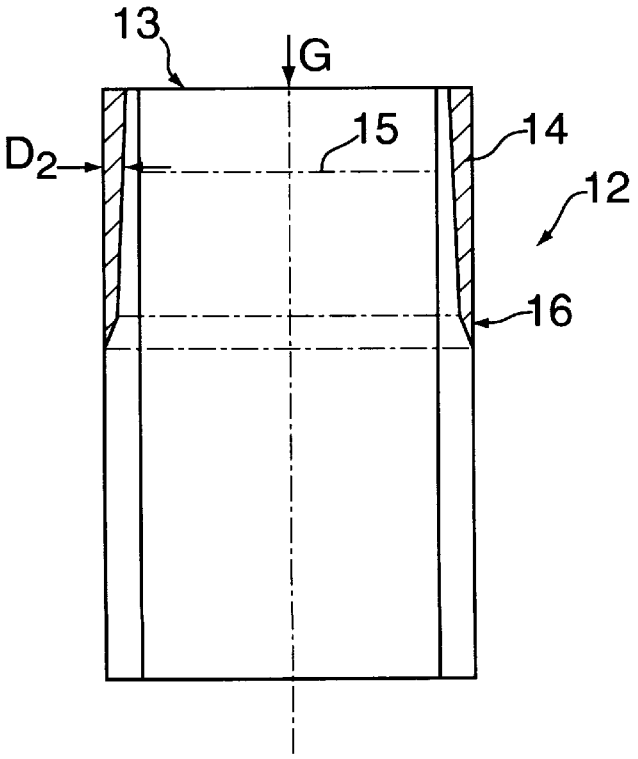

Another embodiment of a mold tube 12 is illustrated in FIG. 2. On the pour-in side 13 it has external plating 14 to reduce heat removal. Plating 14 extends over the area of the height of meniscus 15, with thickness $D_2$ of plating 14 diminishing in the casting direction G. One possible embodiment of plating 14 provides for a thickness $D_2$ diminishing from 3 mm to 1 mm with a continuous transition area 16 at the end.

Figure 3:
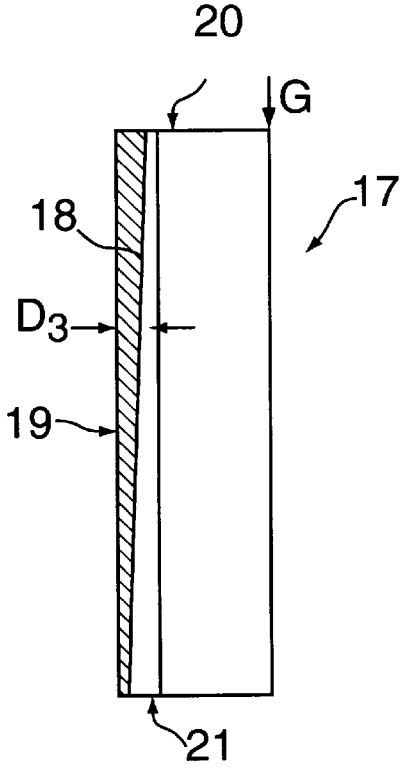

FIG. 3 shows a section of another variant of a mold tube 17. Mold tube 17 has plating 18 on the outside 19, whose thickness $D_3$ diminishes linearly from front end 20 to rear end 21. The heat removal is reduced in mold tube 17 by plating 18. The heat flow, however, increases overall from front end 20 of the mold tube to rear end 21.

The mold body of a mold according to the present invention does not necessarily have to be a mold tube. The invention is equally advantageous for multipart casting molds such as plate molds.

What is claimed is:

1. A mold for a continuous casting system, comprising:

a shaping mold body made of a material having a high level of thermal conductivity, the mold body having an outer surface and an inner surface;

at least one plating of a material having a lower level of thermal conductivity than the material of the mold body, the plating being located along the outer surface of the mold body.

2. A mold as set forth in claim 1, wherein the plating is applied at the height of a meniscus that forms in the mold cavity when it is charged with a stream of molten material.

3. A mold as set forth in claim 2, wherein the plating is applied along a portion of the circumferential extent of the mold body.

4. A mold as set forth in claim 1, wherein the plating is applied along a portion of the circumferential extent of the mold body.

5. A mold as set forth in claim 1, wherein the plating is applied by electroplating.

6. A mold as set forth in claim 2, wherein the plating is applied by electroplating.

7. A mold as set forth in claim 1, wherein the plating is applied as a thermal spray layer.

8. A mold as set forth in claim 1, wherein the plating is made of nickel or an alloy of nickel.

9. A mold as set forth in claim 3, wherein the plating is made of nickel or an alloy of nickel.

10. A mold as set forth in claim 1, wherein the mold body defines a casting direction, and the plating has a constant thickness in the casting direction.

11. A mold as set forth in claim 1, wherein the mold body defines a casting direction, and the plating has a thickness that diminishes in the casting direction.

12. A mold as set forth in claim 1, wherein the mold body has plating along its inner surface.

13. A mold as set forth in claim 2, wherein the mold body has plating along its inner surface.

14. A mold as set forth in claim 11, wherein the plating has a maximum thickness of 3 mm.

15. A mold as set forth in claim 14, wherein the plating tapers in thickness diminishing from 3 mm to 1 mm with a continuous translation area at the end.

16. A mold as set forth in claim 11, wherein the plating varies linearly in thickness.

17. A mold as set forth in claim 1, wherein the mold is made of copper.

18. A mold as set forth in claim 1, wherein the mold is made of an alloy of copper.

* * * * *